US012806496B2

(12) United States Patent
Norman

(10) Patent No.: US 12,806,496 B2
(45) Date of Patent: Nov. 24, 2026

(54) BASKETBALL RETURN ASSEMBLY FOR RETURNING A BASKETBALL TO A SHOOTER AFTER A SHOT

(71) Applicant: Gregory Norman, Rockwall, TX (US)

(72) Inventor: Gregory Norman, Rockwall, TX (US)

( * ) Notice: Subject to any disclaimer, the term of this patent is extended or adjusted under 35 U.S.C. 154(b) by 104 days.

(21) Appl. No.: 19/053,519

(22) Filed: Feb. 14, 2025

(65) Prior Publication Data

US 2026/0241248 A1 Aug. 20, 2026

(51) Int. Cl.
*A63B 63/08* (2006.01)
*A63B 63/00* (2006.01)

(52) U.S. Cl.
CPC ..... *A63B 63/083* (2013.01); *A63B 2063/001* (2013.01)

(58) Field of Classification Search
CPC ..... A63B 63/083; A63B 69/0074; A63B 2063/001
See application file for complete search history.

(56) References Cited

U.S. PATENT DOCUMENTS 4,786,371 A * 11/1988 Postol ..... A63B 69/0071 473/433
4,957,289 A * 9/1990 Kotlarz ..... A63B 63/083 473/433
5,681,230 A * 10/1997 Krings ..... A63B 69/0071 473/433
6,074,313 A * 6/2000 Pearson ..... A63B 63/083 473/433
6,733,403 B2 * 5/2004 Courtright ..... A63B 69/0071 473/433
11,278,785 B1 * 3/2022 Wiesolek ..... A63B 69/0071
2004/0018898 A1 * 1/2004 Courtright ..... A63B 69/0071 473/433
2006/0183571 A1 * 8/2006 Hudson ..... A63B 69/0071 473/433
2006/0293126 A1 * 12/2006 Thomas ..... A63B 63/083 473/481
2011/0130225 A1 * 6/2011 Sims ..... A63B 63/083 473/433
2014/0135149 A1 * 5/2014 Atkins ..... A63B 63/083 473/433
2015/0051023 A1 * 2/2015 Aipperspach ..... A63B 69/0071 473/433
2016/0287964 A1 * 10/2016 Jones ..... A63B 63/083
2024/0050825 A1 * 2/2024 Stucker ..... A63B 63/083

* cited by examiner

*Primary Examiner* — Shane Bomar

(57) ABSTRACT

A basketball return assembly for returning a basketball to a shooter after a shot includes a frame enclosing a space. A pair of backboard couplers is attached to a top frame piece. The backboard couplers are attachable to a backboard of a basketball hoop to suspend the frame from and under the backboard parallel to the backboard. The backboard couplers are designed to freely pivot the frame to different angles with respect to the backboard. A panel is coupled to the frame and extending across the space within the frame. The panel includes a flexible material pulled taut on the frame. A cord is coupled to the frame. A rim coupler is coupled to the cord. The rim coupler is designed to detachably couple the cord to a rim of the basketball hoop to suspend the frame at an angled position with respect to the backboard and projecting out under the rim.

20 Claims, 8 Drawing Sheets

BASKETBALL RETURN ASSEMBLY FOR RETURNING A BASKETBALL TO A SHOOTER AFTER A SHOT

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to basketball return devices and more particularly pertains to a new basketball return assembly for both returning missed shots and made shots, and which is suspended from the backboard alone. Most basketball return devices only have one position, and that is angled under the hoop to return made shots, and/or have complex and large constructions that are difficult to install, take up large amounts of space, and must be removed to allow normal use of the basketball hoop. The new basketball return assembly can be used to return made shots, but is easily movable to a position extending down from the backboard to function as a rebound surface for missed shots without detachment from the basketball hoop.

(2) Description of Related Art Including Information Disclosed Under 37 CFR 1.97 and 1.98

The prior art relates to basketball return devices that either have a contoured shape, fixed position with respect to the basketball hoop, or are supported on the ground or a pole of the basketball hoop. The prior art, as best understood, does not disclose a basketball return assembly that includes a frame, a panel in the frame, and a pair of backboard couplers attachable to a backboard of a basketball hoop to suspend the frame from and under the backboard parallel to the backboard to deflect a basketball shot under the backboard in a direction away from the backboard and into a play area in front of the basketball hoop. The backboard couplers are designed to freely pivot the frame to different angles with respect to the backboard. A cord is coupled to the frame and a rim coupler is coupled to the cord that is designed to detachably couple the cord to a rim of the basketball hoop to suspend the frame at an angled position with respect to the backboard and projecting out under the rim to deflect a basketball passing through the rim in a direction away from the backboard and into the play area in front of the basketball hoop.

(h) BRIEF SUMMARY OF THE INVENTION

An embodiment of the disclosure meets the needs presented above in a basketball return assembly for returning a basketball to a shooter after a shot generally comprising a frame enclosing a space. The frame has a top frame piece, a bottom frame piece, and a pair of side frame pieces connecting the top frame piece and the bottom frame piece. A pair of backboard couplers is attached to the top frame piece. The backboard couplers are attachable to a backboard of a basketball hoop to suspend the frame from and under the backboard parallel to the backboard to deflect a basketball shot under the backboard in a direction away from the backboard and into a play area in front of the basketball hoop. The backboard couplers are designed to freely pivot the frame to different angles with respect to the backboard. A panel is coupled to the frame. The panel is positioned to extend across the space within the frame. The panel includes a flexible material pulled taut on the frame. A cord is coupled to the frame. A rim coupler is coupled to the cord. The rim coupler is designed to detachably couple the cord to a rim of the basketball hoop to suspend the frame at an angled position with respect to the backboard and projecting out under the rim to deflect a basketball passing through the rim in a direction away from the backboard and into the play area in front of the basketball hoop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
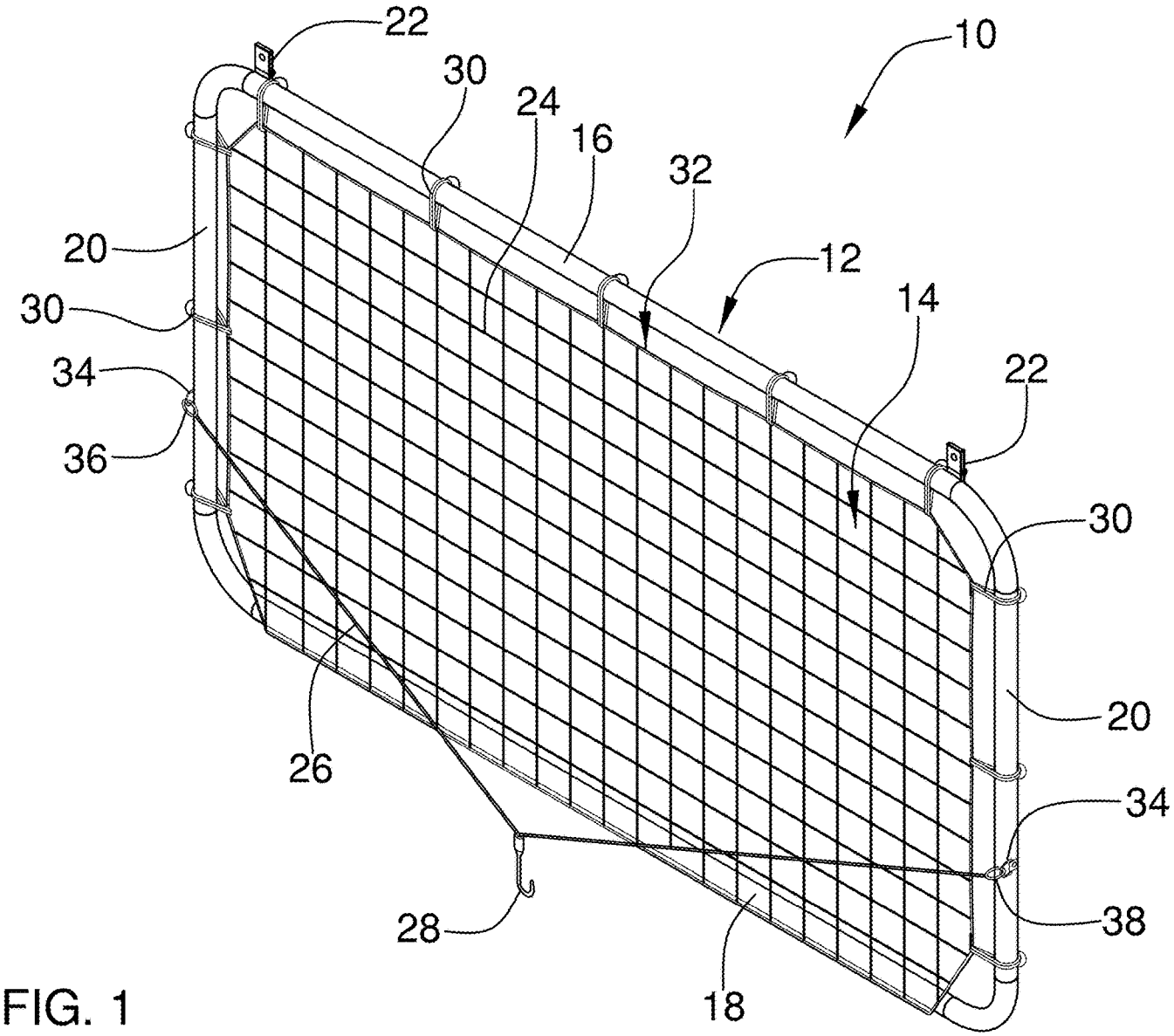
FIG. 1 is a perspective view of a basketball return assembly according to an embodiment of the disclosure.

With reference now to the drawings, and in particular to FIGS. 1 through 8 thereof, a new basketball return assembly embodying the principles and concepts of an embodiment of the disclosure and generally designated by the reference numeral 10 will be described.

As best illustrated in FIGS. 1 through 8, the basketball return assembly 10 generally comprises a frame 12 enclosing a space 14. The frame 12 has a top frame piece 16, a bottom frame piece 18, and a pair of side frame pieces 20 connecting the top frame piece 16 and the bottom frame piece 18. A pair of backboard couplers 22 is attached to the top frame piece 16. The backboard couplers 22 are attachable to a backboard 64 of a basketball hoop 62 to suspend the frame 12 from and under the backboard 64 parallel to the backboard 64 to deflect a basketball 60 shot under the backboard 64 in a direction away from the backboard 64 and into a play area in front of the basketball hoop 62. The backboard couplers 22 are designed to freely pivot the frame 12 to different angles with respect to the backboard 64. A panel 24 is coupled to the frame 12. The panel 24 is positioned to extend across the space 14 within the frame 12. The panel 24 includes a flexible material pulled taut on the frame 12. A cord 26 is coupled to the frame 12. A rim coupler 28 is coupled to the cord 26. The rim coupler 28 is designed to detachably couple the cord 26 to a rim 66 of the basketball hoop 62 to suspend the frame 12 at an angled position with respect to the backboard 64 and projecting out under the rim 66 to deflect a basketball 60 passing through the rim 66 in a direction away from the backboard 64 and into the play area in front of the basketball hoop 62.

Figure 4:
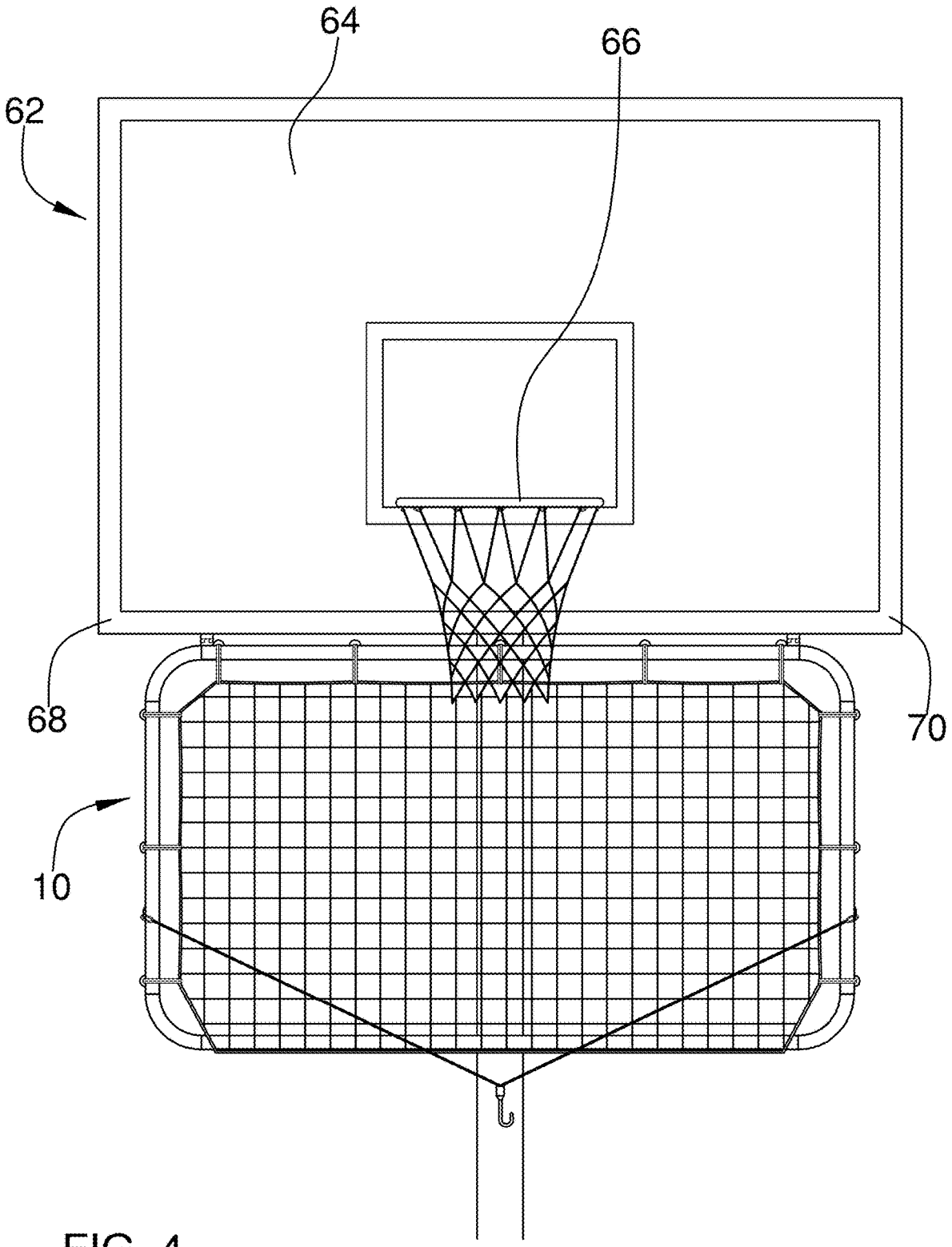
FIG. 4 is a front view of an embodiment of the disclosure in use.
Figure 5:
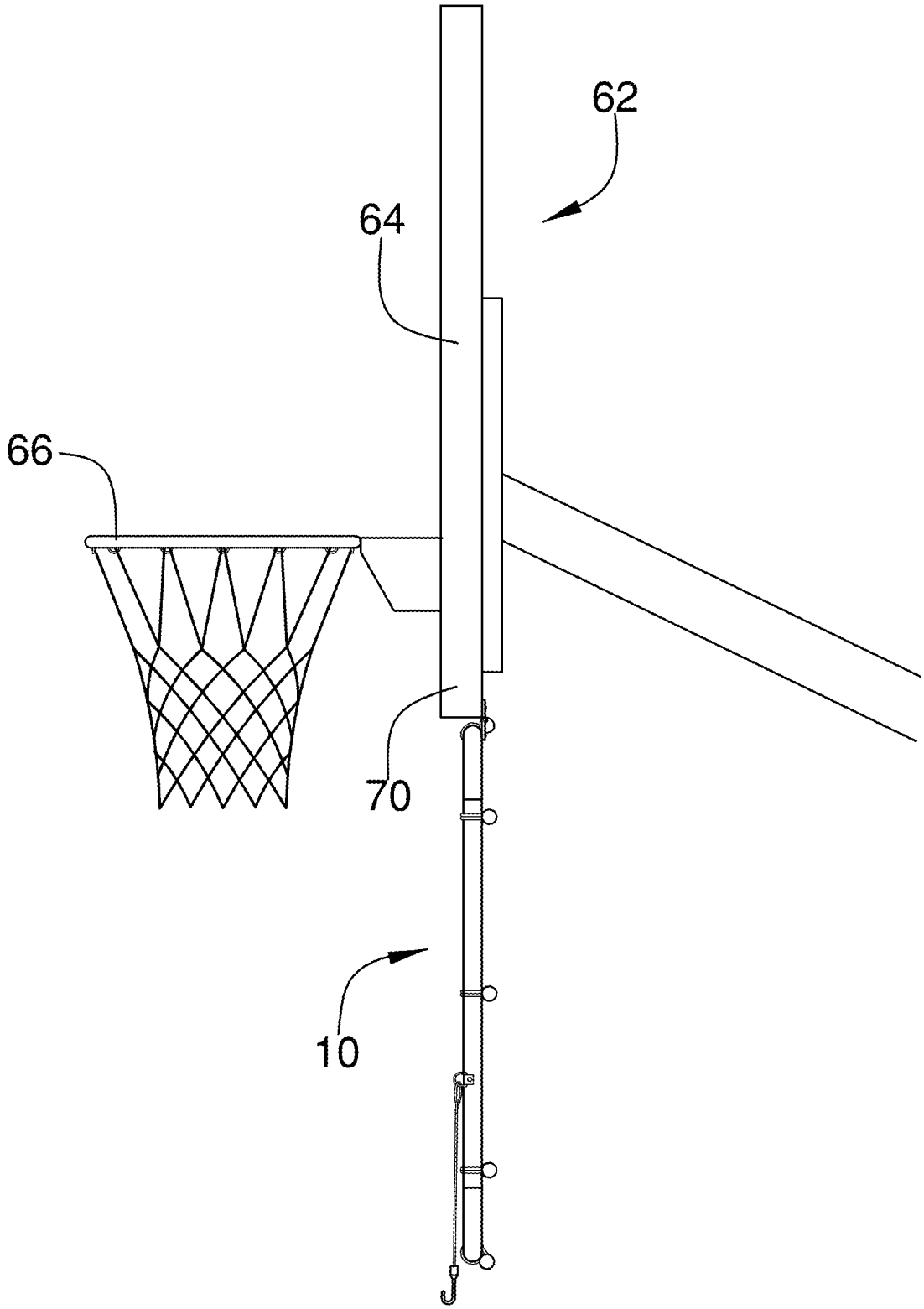
FIG. 5 is a side view of an embodiment of the disclosure in use.

In the exemplary embodiment shown in FIG. 4, the top frame piece 16 is designed to extend from a left bottom corner 68 of the backboard 64 to the right bottom corner 70. Each the backboard couplers 22 is positioned to attach to the backboard 64 adjacent a respective one of the left bottom corner 68 and the right bottom corner 70. In another possible embodiment, the backboard couplers 22 could be located more centrally on the backboard 64. There could also be more than two backboard couplers 22. In another possible embodiment, the top frame piece 16 could be wider or substantially smaller than the backboard 64. In the exemplary embodiment in FIG. 4, the frame 12 is rectangular. The top frame piece 16 is positioned parallel to the bottom frame piece 18. The side frame pieces 20 are positioned parallel to one another and perpendicular to each of the top frame piece 16 and the bottom frame piece 18. The top frame piece 16 is longer than each of the side frame pieces 20. However, in another possible embodiment, the frame 12 could be other shapes, such as square, trapezoidal, or triangular. In the exemplary embodiment, each of the top frame piece 16, the bottom frame piece 18, and the side frame pieces 20 is a tube, such as a lightweight aluminum tube or plastic tube.

Figure 2:
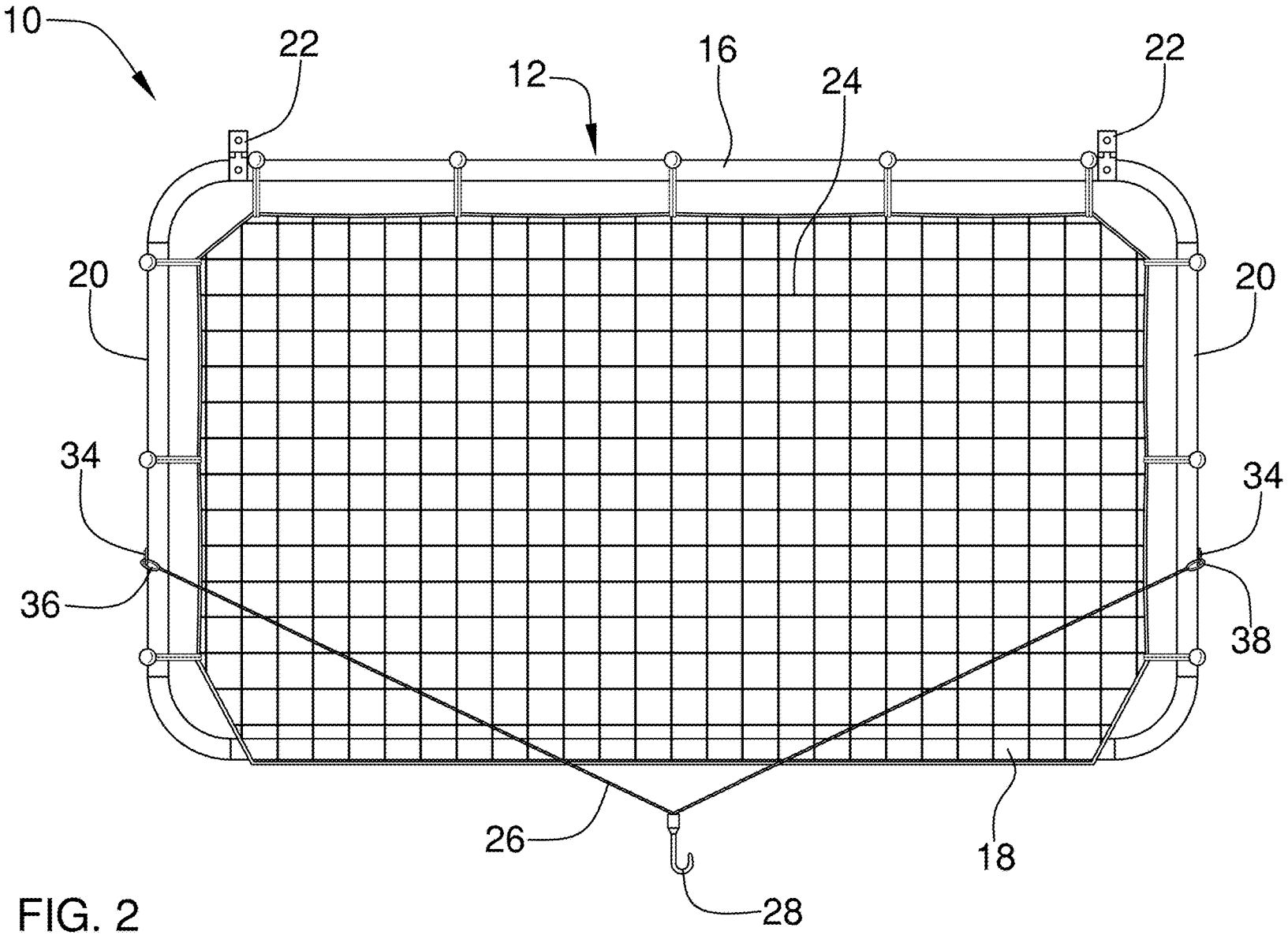
FIG. 2 is a rear view of an embodiment of the disclosure.
Figure 3:
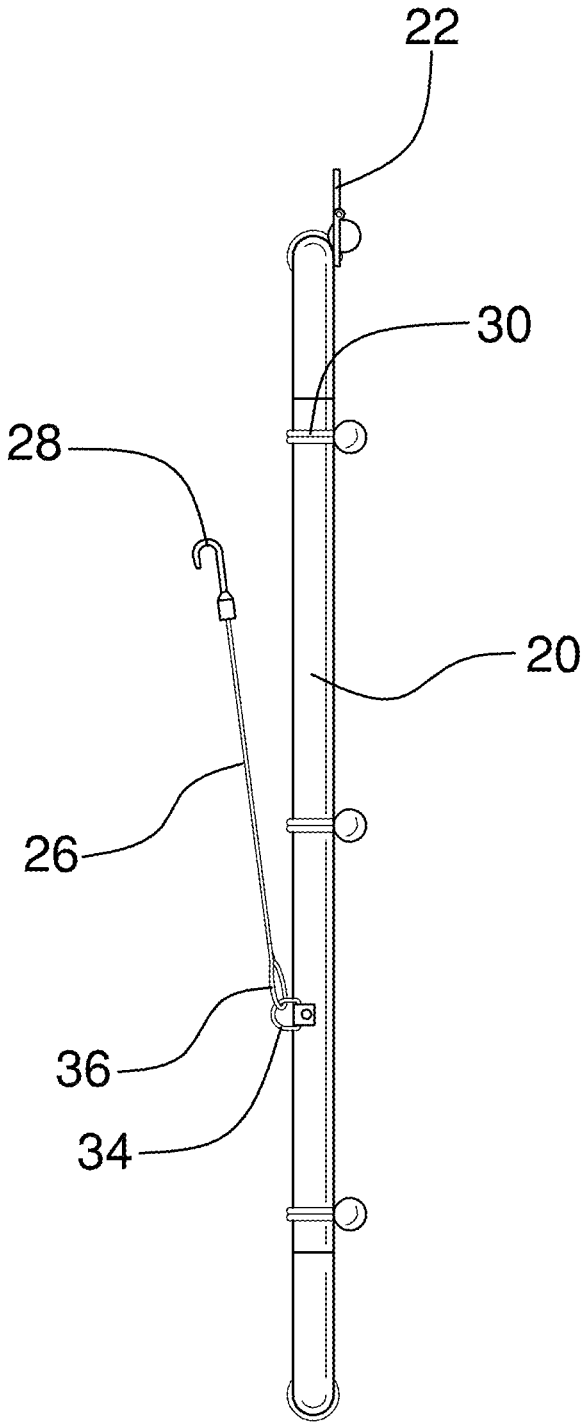
FIG. 3 is a side view of an embodiment of the disclosure.

As shown in FIG. 2, the basketball return assembly 10 further includes a plurality of straps 30 positioned about a perimeter edge 32 of the panel 24 and connecting the panel 24 to the frame 12 a distance from the frame 12, wherein each of the straps 30 is resilient to stretch the panel 24 taut. For example, the straps 30 could be elastic connectors, such as bungee cords or rubber pieces. In the exemplary embodiment in FIG. 2, the straps 30 are positioned on three sides of the perimeter edge 32 of the panel 24 to connect the panel 24 to the top frame piece 16 and each of the side frame pieces 20. A fourth side of the perimeter edge 32 is coupled to the bottom frame piece 18 such that the basketball 60 can roll along the panel 24 and be guided over the bottom frame piece 18. In another possible embodiment, the straps 30 are on all four sides and the panel 24 is completely spaced apart from the frame 12. In another possible embodiment, the straps 30 could be omitted and the panel 24 could be made of resilient material stretched taut over the frame 12 on all four sides. In the exemplary embodiment, the panel 24 is a net, though a solid design is within the scope of the disclosure.

In the exemplary embodiment, each of the backboard couplers 22 is in the form of a right-angle hinge such that the frame 12 is maintained in a radial orientation with respect to an axis of rotation parallel to the bottom edge of the backboard 64. This design maintains the orientation of the frame 12 facing towards the area of play when contacted by the basketball 60 and thereby promotes consistent return of the basketball 60. However, instead of hinges, other devices could be used as the backboard couplers 22, such as wires, chains, and springs. The backboard couplers 22 can be permanently installed on the backboard, or affixed with screws or bolts, or removably connected with clips or clamps. For example, an elongated clamp or bracket could be used that extends along the backboard 64 from the top edge to the bottom edge.

The basketball return assembly 10 further includes a pair of rings 34, such as D-rings or eyelets. Each of the rings 34 is attached to a respective one of the side frame pieces 20, wherein each of a first end 36 and a second end 38 of the cord 26 is coupled to a respective one of the rings 34, such as by eye loops interlocked with the rings 34. In the exemplary embodiment, the rim coupler 28 is a hook attached to the cord 26. In another possible embodiment, carabiners, clips, or other detachable connectors can be used as the rim coupler 28 and to attach the cord 26 to the rings 34.

Figure 6:
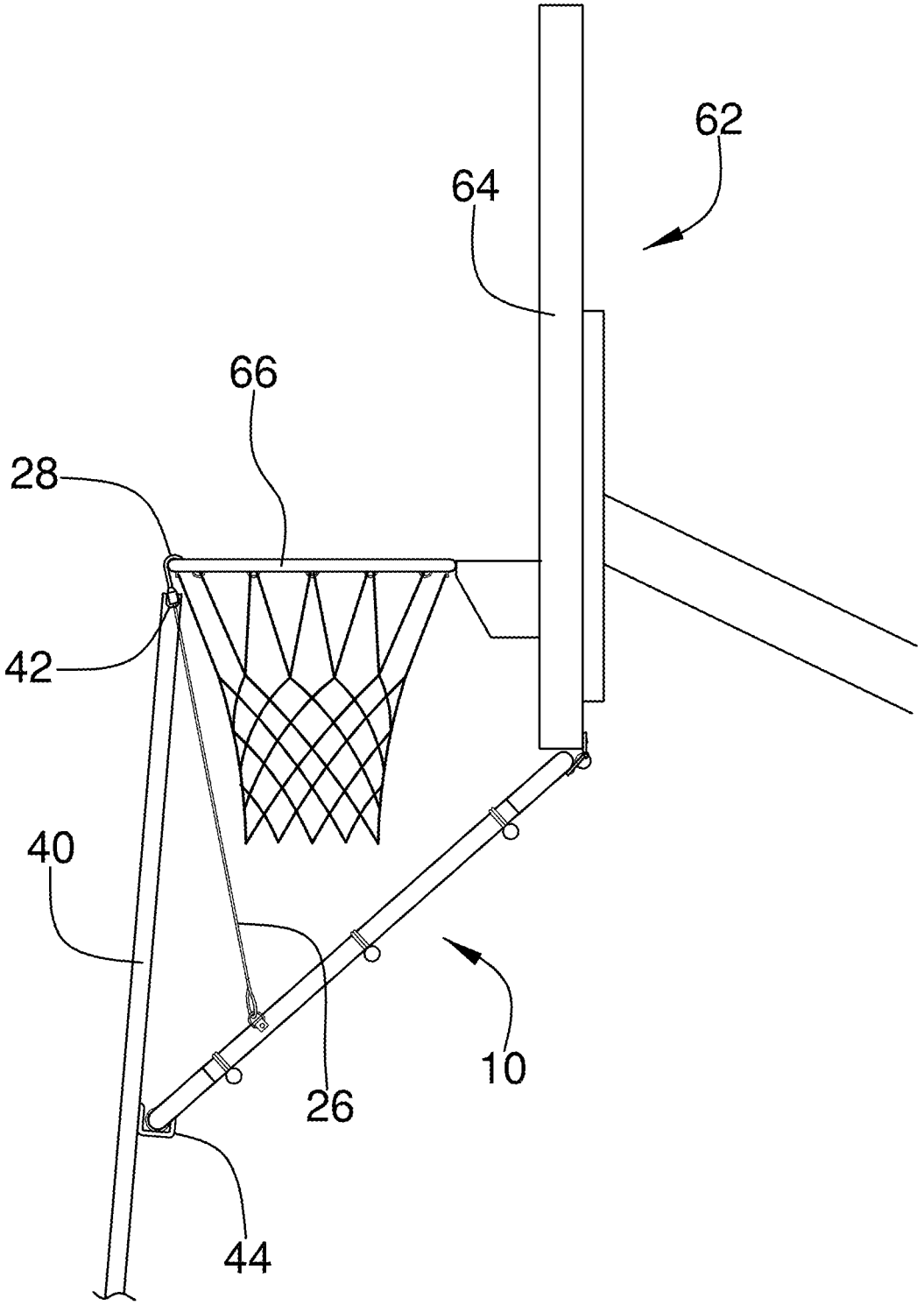
FIG. 6 is a side view of an embodiment of the disclosure in use.

In the exemplary embodiment shown in FIG. 6, the basketball return assembly 10 further includes a lifting rod 40 to selectively lift the frame 12 into the angled position under the rim 66 of the basketball hoop 62. The lifting rod 40 includes a recess 42 positioned in an end of the lifting rod 40. The recess 42 is designed to engage the rim coupler 28 to lift the rim coupler 28 on and off the rim 66 of the basketball hoop 62. The lifting rod 40 also includes a lift arm 44 that is designed to engage the bottom frame piece 18. The lifting rod 40 allows a user to adjust the frame 12 between the parallel position and the angled position without needing to lower the basketball hoop 62 or stand on a chair or step ladder.

Figure 7:
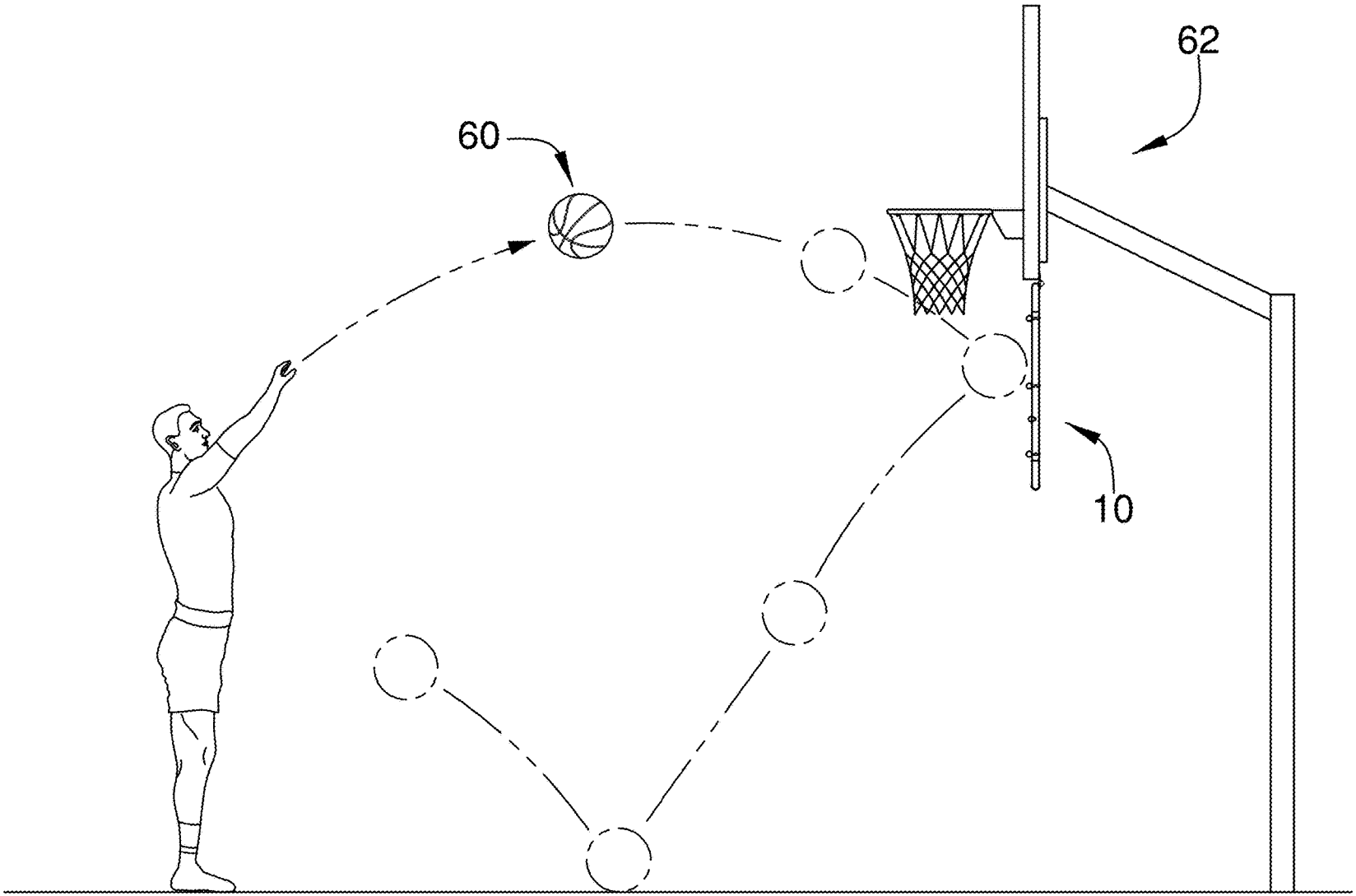
FIG. 7 is a side view of an embodiment of the disclosure in use.
Figure 8:
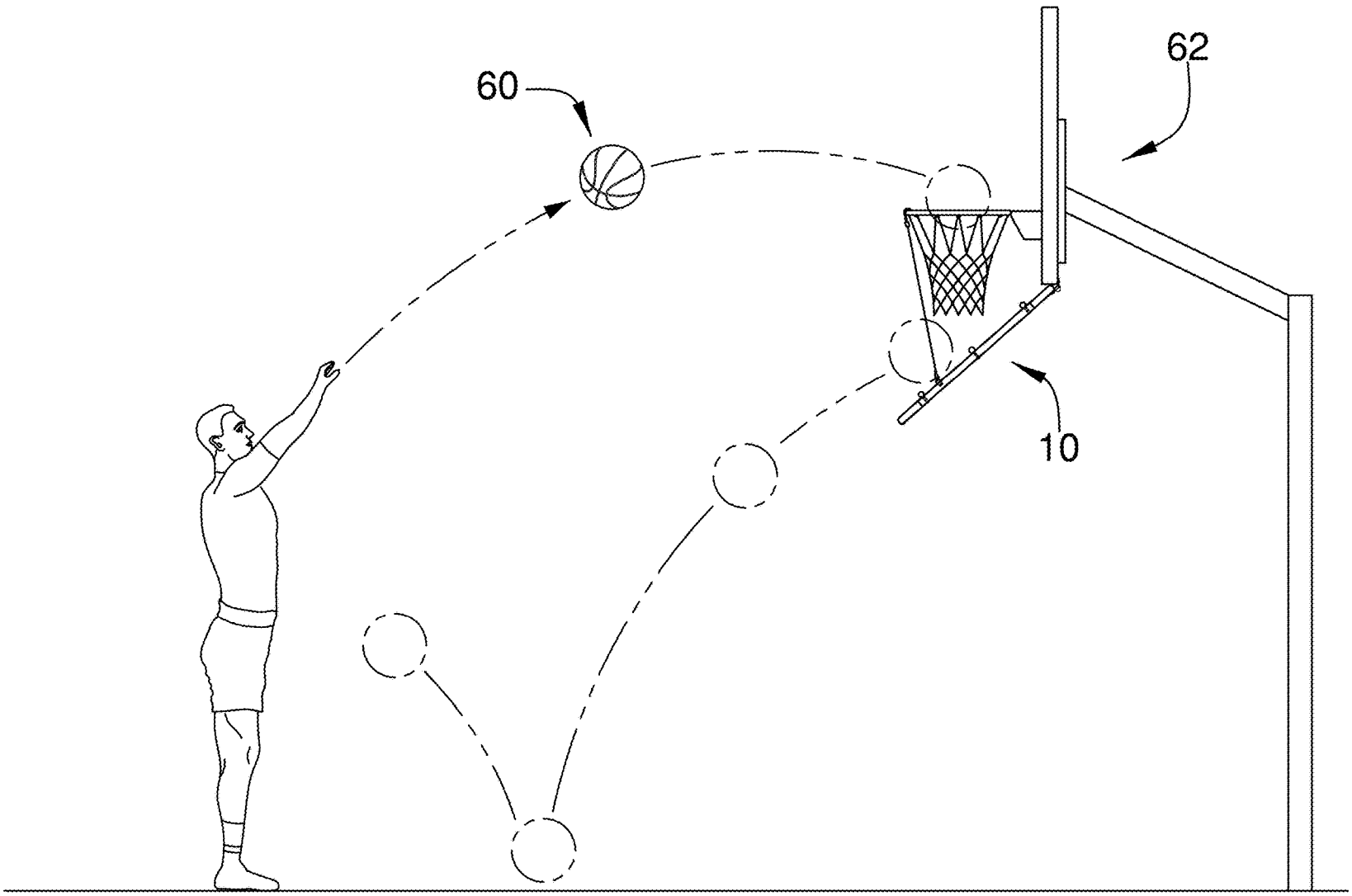
FIG. 8 is a side view of an embodiment of the disclosure in use.

FIGS. 4 through 8 show the basketball return assembly 10 installed on the basketball hoop 62 and how to use the basketball return assembly 10. The frame 12 is attached to the backboard 64 by the backboard couplers 22. The frame 12 hangs from the backboard 64 in the parallel position shown in FIGS. 4 and 5. In the parallel position, the frame 12 acts as a freely-swinging extension of the backboard 64 to block and return missed shots of the basketball 60, as shown in FIG. 7. The parallel position allows players to use the basketball hoop 62 for normal play without interfering with the play, as would be the case if the basketball return assembly 10 is in the angled position shown in FIG. 8. The basketball return assembly 10 can be selectively moved and held in the angled position shown in FIG. 6 by coupling the hook to the front of the rim 66. The basketball return assembly 10 now functions as an automatic return for made shots of the basketball 60, as shown in FIG. 8.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A basketball return assembly for returning a basketball to a shooter after a shot comprising:

a frame enclosing a space, said frame having a top frame piece, a bottom frame piece, and a pair of side frame pieces connecting said top frame piece and said bottom frame piece;

a pair of backboard couplers attached to said top frame piece, said backboard couplers being attachable to a backboard of a basketball hoop to suspend said frame from and under the backboard parallel to the backboard to deflect a basketball shot under the backboard in a direction away from the backboard and into a play area in front of the basketball hoop, said backboard couplers are configured to freely pivot said frame to different angles with respect to the backboard;

a panel being coupled to said frame, said panel being positioned to extend across said space within said frame, said panel includes a flexible material pulled taut on said frame;

a cord being coupled to said frame; and a rim coupler being coupled to said cord, said rim coupler being configured to detachably couple said cord to a rim of the basketball hoop to suspend said frame at an angled position with respect to the backboard and projecting out under the rim to deflect a basketball passing through the rim in a direction away from the backboard and into the play area in front of the basketball hoop.

2. The basketball return assembly of claim 1, wherein:

said top frame piece is configured to extend from a left bottom corner of the backboard to the right bottom corner; and each of said backboard couplers is positioned to attach to the backboard adjacent a respective one of the left bottom corner and the right bottom corner.

3. The basketball return assembly of claim 2, wherein said backboard couplers are hinges.

4. The basketball return assembly of claim 3, wherein each of said hinges is a right-angle hinge such that said frame is maintained in a radial orientation with respect to an axis of rotation parallel to the bottom edge of the backboard.

5. The basketball return assembly of claim 1, wherein each of said top frame piece, said bottom frame piece, and said side frame pieces is a tube.

6. The basketball return assembly of claim 1, wherein:

said frame is rectangular;

said top frame piece is positioned parallel to said bottom frame piece;

said side frame pieces are positioned parallel to one another and perpendicular to each of said top frame piece and said bottom frame piece; and said top frame piece is longer than each of said side frame pieces.

7. The basketball return assembly of claim 1, further comprising a plurality of straps being positioned about a perimeter edge of said panel and connecting said panel to said frame a distance from said frame, wherein each of said straps is resilient to stretch said panel taut.

8. The basketball return assembly of claim 7, wherein:

said straps are positioned on three sides of said perimeter edge of said panel to connect said panel to said top frame piece and each of said side frame pieces; and a fourth side of said perimeter edge is coupled to said bottom frame piece such that the basketball can roll along said panel and be guided over the bottom frame piece.

9. The basketball return assembly of claim 1, wherein said panel is a net.

10. The basketball return assembly of claim 1, further comprising a pair of rings, each of said rings being attached to a respective one of said side frame pieces, wherein each of a first end and a second end of said cord is coupled to a respective one of said rings.

11. The basketball return assembly of claim 1, wherein said rim coupler is a hook attached to said cord.

12. The basketball return assembly of claim 1, further comprising a lifting rod to selectively lift said frame into the angled position under the rim of the basketball hoop, said lifting rod including a recess positioned in an end of said lifting rod, said recess being configured to engage said rim coupler to lift said rim coupler on and off the rim of the basketball hoop, said lifting rod including a lift arm being configured to engage said bottom frame piece.

13. The basketball return assembly of claim 4, wherein each of said top frame piece, said bottom frame piece, and said side frame pieces is a tube.

14. The basketball return assembly of claim 13, wherein:

said frame is rectangular;

said top frame piece is positioned parallel to said bottom frame piece;

said side frame pieces are positioned parallel to one another and perpendicular to each of said top frame piece and said bottom frame piece; and said top frame piece is longer than each of said side frame pieces.

15. The basketball return assembly of claim 14, further comprising a plurality of straps being positioned about a perimeter edge of said panel and connecting said panel to said frame a distance from said frame, wherein each of said straps is resilient to stretch said panel taut.

16. The basketball return assembly of claim 15, wherein:

said straps are positioned on three sides of said perimeter edge of said panel to connect said panel to said top frame piece and each of said side frame pieces; and a fourth side of said perimeter edge is coupled to said bottom frame piece such that the basketball can roll along said panel and be guided over the bottom frame piece.

17. The basketball return assembly of claim 16, wherein said panel is a net.

18. The basketball return assembly of claim 17, further comprising a pair of rings, each of said rings being attached to a respective one of said side frame pieces, wherein each of a first end and a second end of said cord is coupled to a respective one of said rings.

19. The basketball return assembly of claim 18, wherein said rim coupler is a hook attached to said cord.

20. The basketball return assembly of claim 19, further comprising a lifting rod to selectively lift said frame into the angled position under the rim of the basketball hoop, said lifting rod including a recess positioned in an end of said lifting rod, said recess being configured to engage said rim coupler to lift said rim coupler on and off the rim of the basketball hoop, said lifting rod including a lift arm being configured to engage said bottom frame piece.

* * * * *